US010861418B2

(12) United States Patent
Zhang et al.

(10) Patent No.: US 10,861,418 B2
(45) Date of Patent: Dec. 8, 2020

(54) METHODS, DEVICES, AND STORAGE MEDIUM FOR DETERMINING AMBIENT BRIGHTNESS

(71) Applicant: BEIJING XIAOMI MOBILE SOFTWARE CO., LTD., Beijing (CN)

(72) Inventors: Yuan Zhang, Beijing (CN); Gang Wang, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 0 days.

(21) Appl. No.: 16/439,666

(22) Filed: Jun. 12, 2019

(65) Prior Publication Data

US 2019/0385572 A1 Dec. 19, 2019

(30) Foreign Application Priority Data

Jun. 15, 2018 (CN) ..... 2018 1 0621702

(51) Int. Cl.
*G09G 5/10* (2006.01)

(52) U.S. Cl.
CPC ..... *G09G 5/10* (2013.01); *G09G 2320/0626* (2013.01); *G09G 2360/144* (2013.01)

(58) Field of Classification Search
USPC ..... 345/204, 205, 207, 82, 690, 691, 699; 315/152, 293; 324/750.03
See application file for complete search history.

(56) References Cited

U.S. PATENT DOCUMENTS 4,514,727 A * 4/1985 Van Antwerp ..... G09G 5/10 345/691
4,682,857 A * 7/1987 Tan ..... G01R 31/2656 324/750.03
7,956,554 B2 * 6/2011 Shteynberg ..... H05B 45/24 315/293
8,723,766 B2 * 5/2014 Shteynberg ..... H05B 45/24 345/82
2013/0113973 A1 * 5/2013 Miao ..... G09G 3/003 348/333.01
2014/0132158 A1 * 5/2014 Land ..... G09G 3/20 315/152

(Continued)

FOREIGN PATENT DOCUMENTS

CN 107945747 A 4/2018

OTHER PUBLICATIONS

First Office Action issued to EP Application No. 19180249.5, dated Nov. 15, 2019, (10p).

*Primary Examiner* — Thuy N Pardo
(74) *Attorney, Agent, or Firm* — Arch & Lake LLP

(57) ABSTRACT

A method, a storage medium, and a device are provided for determining ambient brightness in the field of electronic technology. The method includes: outputting a control signal by the IC to the display screen, the control signal being configured to control brightness of the display screen; sending an instruction message by the IC to the brightness sensor when a level of the control signal is a first level, the first level being configured to control the display screen to display black, the instruction message being configured to instruct the brightness sensor to acquire an optical signal passing through the display screen; and determining an ambient brightness value by the brightness sensor based on the optical signal.

12 Claims, 10 Drawing Sheets

(56) References Cited

U.S. PATENT DOCUMENTS

| | | | | |
|---|---|---|---|---|
| 2017/0110051 | A1* | 4/2017 | Gardner, Jr. | G06F 3/041 345/207 |
| 2017/0287392 | A1* | 10/2017 | Lynch | G06F 3/0421 345/173 |
| 2018/0151131 | A1* | 5/2018 | Files | G06F 3/1423 345/691 |
| 2018/0174552 | A1* | 6/2018 | Zhang | H01L 27/1262 345/691 |
| 2018/0263091 | A1* | 9/2018 | Daman | H01H 13/83 345/82 |
| 2019/0108794 | A1* | 4/2019 | Files | G09G 3/342 345/690 |
| 2019/0287466 | A1* | 9/2019 | Yin | G09G 3/3406 345/204 |
| 2020/0039354 | A1* | 2/2020 | Kulkarni | B60T 17/22 345/205 |
| 2020/0152122 | A1* | 5/2020 | Gardner, Jr. | H05B 47/10 345/207 |

* cited by examiner

METHODS, DEVICES, AND STORAGE MEDIUM FOR DETERMINING AMBIENT BRIGHTNESS

CROSS-REFERENCE TO RELATED APPLICATIONS

This application is based on and claims priority to Chinese Patent Application No. 201810621702.X, filed on Jun. 15, 2018, the entire contents of which are incorporated herein by reference.

TECHNICAL FIELD

The present disclosure generally relates to the field of electronic technology, and more particularly, to a method and a device for determining ambient brightness, and a storage medium.

BACKGROUND

A full-screen terminal refers to a terminal having a screen-to-body ratio of nearly 100%. Compared with terminals in the related art in which sensors are disposed in the forehead portion of the terminals, the sensor in the full-screen terminal needs to be set in other portions of the terminal, so that the display screen can occupy a larger area on the panel.

In the related art, a brightness sensor can be disposed under the display screen, to obtain the ambient brightness value. The brightness sensor can convert the optical signal passing through the display screen into the electrical signal, so that the terminal can determine the brightness value corresponding to the electrical signal according to the electrical signal acquired by the brightness sensor. The brightness value corresponding to the electrical signal includes the brightness value of the ambient light and the brightness value of the display screen. Then, the terminal can acquire the brightness value of the display screen, and determine the brightness value of the ambient light according to the brightness value corresponding to the electrical signal and the brightness value of the display screen.

However, the brightness value of the display screen is difficult to obtain, accuracy of the determined brightness value of the ambient light is low.

SUMMARY

In a first aspect, there is provided a method for determining ambient brightness. The method is applicable to a terminal having an integrated circuit (IC), a display screen and a brightness sensor, and the brightness sensor is disposed under the display screen. The method includes: outputting a control signal by the IC to the display screen, the control signal being configured to control brightness of the display screen; sending an instruction message by the IC to the brightness sensor when a level of the control signal is a first level, the first level being configured to control the display screen to display black, the instruction message being configured to instruct the brightness sensor to acquire an optical signal passing through the display screen; and determining an ambient brightness value by the brightness sensor based on the optical signal.

In a second aspect, there is provided device for determining ambient brightness. The device is applicable to a terminal having an IC, a display screen and a brightness sensor, and the brightness sensor is disposed under the display screen. The device includes a processor and a memory configured to store instructions executable by the processor. The processor is configured to: control the IC to output a control signal to the display screen, the control signal being configured to control brightness of the display screen; control the IC to send an instruction message to the brightness sensor when a level of the control signal is a first level, the first level being configured to control the display screen to display black, the instruction message being configured to instruct the brightness sensor to acquire an optical signal passing through the display screen; and control the brightness sensor to determine an ambient brightness value based on the optical signal.

In a third aspect, there is provided a storage medium having instructions stored therein, when the storage medium is run on a processing circuitry, the processing circuitry is caused to perform the method for determining ambient brightness according to the first aspect of embodiments of the present disclosure.

It is to be understood that, both the foregoing general description and the following detailed description are exemplary and explanatory only and are not restrictive of the present disclosure.

BRIEF DESCRIPTION OF THE DRAWINGS

In order to clearly illustrate technical solutions of embodiments of the present disclosure, a brief description of drawings used in embodiments is given below. Obviously, the drawings in the following descriptions are only part embodiments of the present disclosure, and for those skilled in the art, other drawings can be obtained according to these drawings without creative labor.

and

Figure 19:
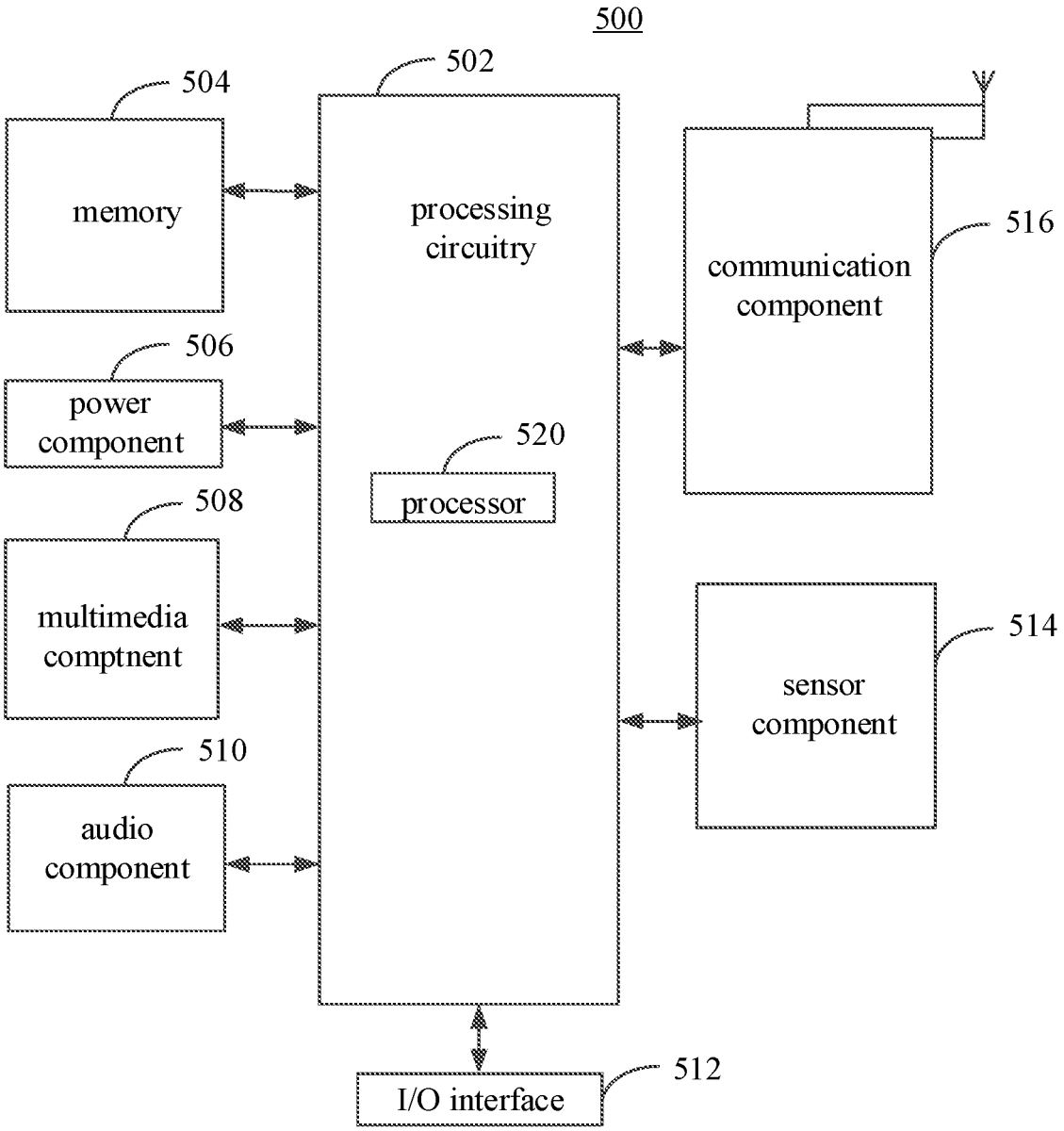

FIG. 19 is a block diagram illustrating a device for determining ambient brightness according to another example.

The accompanying drawings, which are incorporated in and constitute a part of this specification, illustrate embodiments consistent with the present disclosure and, together with the description, serve to explain the principles of the present disclosure.

DETAILED DESCRIPTION

In order to enable those skilled in the art to understand the technical solutions of the present disclosure, reference will be made clearly and completely technical solutions in the embodiments of the present disclosure with accompanying drawings. Obviously, the embodiments described here are only part of the embodiments of the present disclosure and are not all embodiments of the present disclosure. Based on the embodiments of the present disclosure, other embodiments obtained by those skilled in the art without creative labor are within scope of the present disclosure.

In embodiments of the present disclosure, one or more brightness sensors may be disposed under the display screen.

Figure 1:
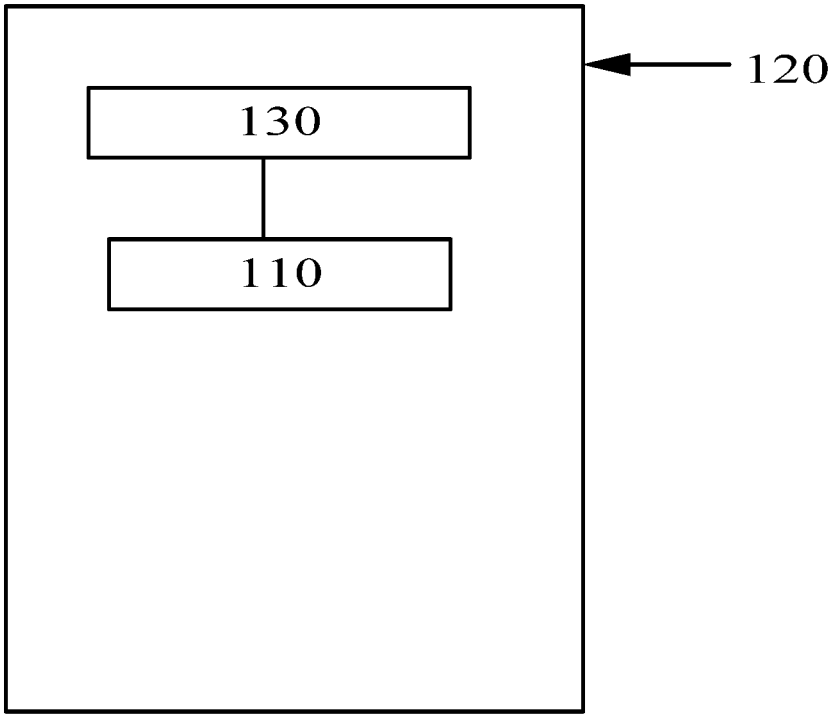
FIG. 1 is a schematic diagram illustrating an implementation environment involved in a method for determining ambient brightness according to an example.

The display screen may be an OLED (Organic Light-Emitting Diode) display screen, an AMOLED (Active-matrix organic light emitting diode) display screen, or a microOLED (micro Organic Light-Emitting Diode) display screen. Referring to FIG. 1, which illustrates a schematic diagram of an implementation environment involved in a method for determining ambient brightness according to an embodiment of the present disclosure. The implementation environment may include an IC (Integrated Circuit) 110, a display screen 120 and a brightness sensor 130. The brightness sensor 130 is disposed under the display screen 120. The IC 110 is electrically coupled to the display screen 120 and the brightness sensor 130, respectively.

Figure 2:
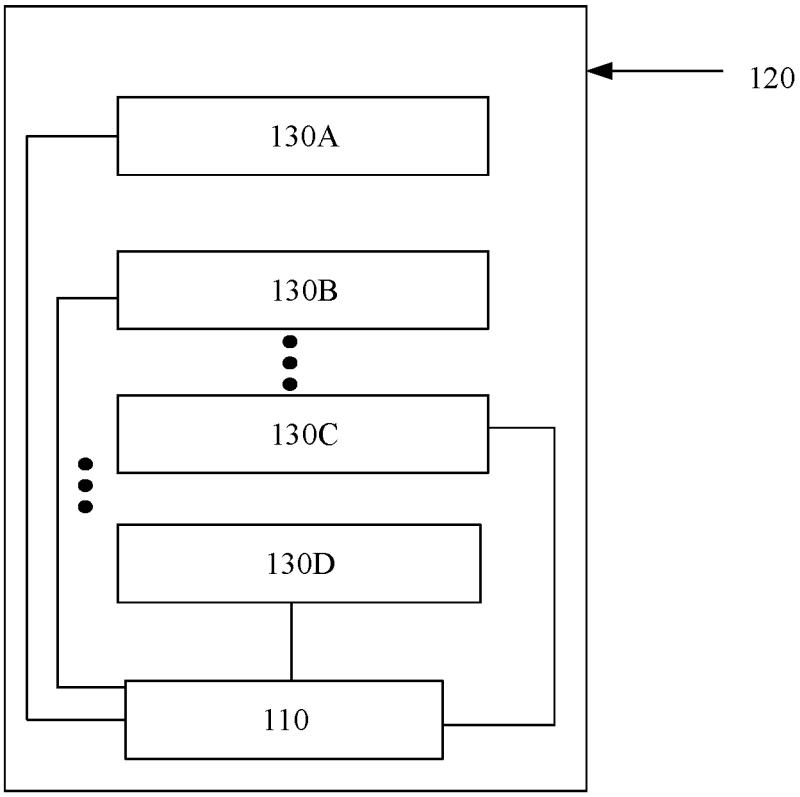
FIG. 2 is a schematic diagram illustrating an implementation environment involved in a method for determining ambient brightness according to an example.

Referring to FIG. 2, which illustrates a schematic diagram of an implementation environment involved in a method for determining ambient brightness according to an embodiment of the present disclosure. The implementation environment may include an IC 110, a display screen 120 and a plurality of brightness sensors 130. The plurality of brightness sensors 130 are evenly distributed in different areas of the display screen 120 in a vertical direction. The IC 110 is electrically coupled to the display screen 120 and the plurality of brightness sensors 130, respectively.

In the related art, the IC can adjust the brightness value of the display screen by controlling the control signal output to the display screen in a duty cycle. The control signal is configured to control the brightness of the display screen, and the duty cycle is a signal cycle of the control signal. The level of the control signal in a duty cycle may include the high level and the low level, or the level of the control signal in a duty cycle may be the low level. The high level is configured to control the display to display black, and the low level is configured to control the brightness of the display screen.

Assuming that the IC only outputs the low level in a duty cycle, and the brightness value of the display screen is 100 nit, when the display screen needs to display the brightness value of 60 nit, a ratio of the high level to the low level in a duty cycle outputted by the IC to the display screen is 40:60, i.e., 2:3.

Figure 3:
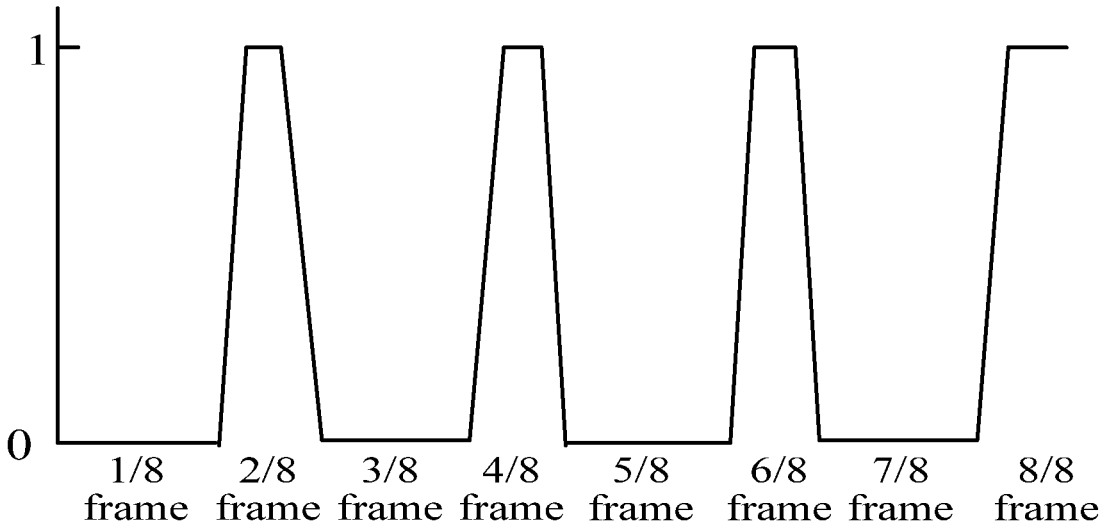
FIG. 3 is a schematic diagram illustrating a time sequence of a control signal for displaying one image frame.
Figure 4:
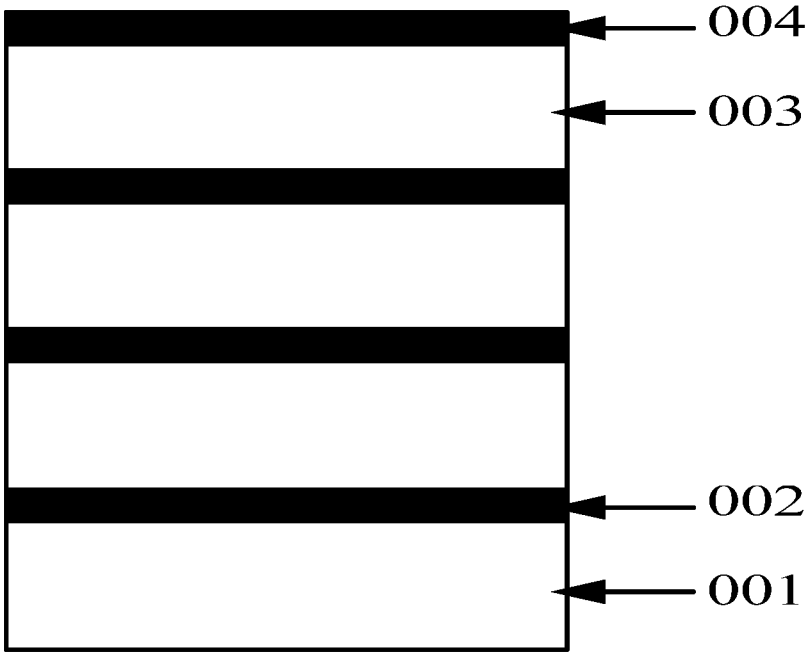
FIG. 4 is a schematic diagram illustrating a control signal for displaying one image frame corresponding to FIG. 3 on a display screen.

In one or more embodiments, in the process of the display screen displaying one image frame, the IC needs to output control signals of 4 duty cycles to the display screen, and the control signals are sequentially moved from the top to the bottom of the display screen. FIG. 3 is a schematic diagram illustrating a time sequence of a control signal for displaying one image frame, in which the abscissa indicates the display progress of each image frame, and the ordinate indicates the level value of the control signals outputted by the IC to the display screen. When the level value of the control signal outputted by the IC to the display screen is 1, it indicates that the control signal has the high level. When the level value of the control signal outputted by the IC to the display screen is 0, it indicates that the control signal has the low level. FIG. 4 is a schematic diagram illustrating a control signal for displaying one image frame corresponding to FIG. 3 on a display screen.

Referring to FIG. 3, the first half of each duty cycle has the low level, and the second half of each duty cycle has the high level. The first half of the first duty cycle in FIG. 3 corresponds to 001 in FIG. 4, and the second half of the first duty cycle in FIG. 3 corresponds to 002 in FIG. 4. The control signal of the first duty cycle is moved from the top to the bottom of the display screen. The first half of the fourth duty cycle in FIG. 3 corresponds to 003 in FIG. 4, and the second half of the fourth duty cycle in FIG. 3 corresponds to 004 in FIG. 4.

Figure 5:
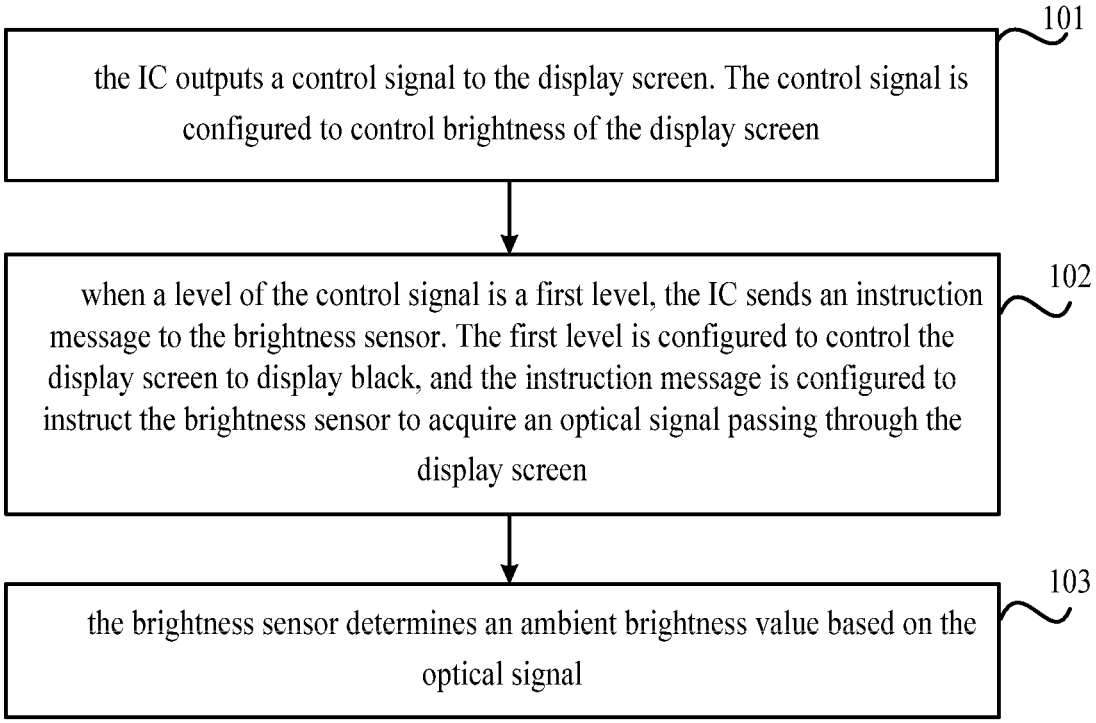
FIG. 5 is a flow chart illustrating a method for determining ambient brightness according to an example.

Embodiments of the present disclosure provide a method for determining ambient brightness, which is applicable to a terminal (such as the terminal shown in FIG. 1 or FIG. 2) having an IC, a display screen and a brightness sensor, the brightness sensor is disposed under the display screen, and the brightness sensor disposed under the display screen may be one or more. As illustrated in FIG. 5, the method may include followings.

At block 101, the IC outputs a control signal to the display screen. The control signal is configured to control brightness of the display screen.

In embodiments of the present disclosure, the IC can determine the control signal output to the display screen based on the brightness value that the display screen needs to display. The control signal may be a pulse signal having a duty ratio.

At block 102, when a level of the control signal is a first level, the IC sends an instruction message to the brightness sensor. The first level is configured to control the display screen to display black, and the instruction message is configured to instruct the brightness sensor to acquire an optical signal passing through the display screen.

Illustratively, the first level may be a high level, and the high level is configured to control the display screen to display black.

The instruction message is configured to instruct the brightness sensor to acquire the optical signal passing through the display screen. Since the brightness sensor acquires the optical signal passing through the display screen when the display screen is black, the optical signal acquired by the brightness sensor is the ambient light.

At block 103, the brightness sensor determines an ambient brightness value based on the optical signal.

In an embodiment of the present disclosure, the brightness sensor can convert the optical signal collected into the electrical signal, and determine the brightness value of the ambient light based on the electrical signal. In another optional implementation, the brightness sensor may also convert the optical signal collected into the electrical signal, and send the electrical signal to the processor, so that the processor determines the brightness value of the ambient light based on the electrical signal.

As described above, with the method for determining ambient brightness according to embodiments of the present disclosure, the IC outputs the control signal to the display screen, when the level of the control signal is the first level, the IC sends the instruction message to the brightness sensor, to instruct the brightness sensor to acquire the optical signal passing through the display screen and to determine the ambient brightness value based on the optical signal. The first level is configured to control the display screen to display black. For example, the control signal may be sent by a diode which merely has on/off state, where the display screen displays back when the diode is in the off state. Since the brightness sensor acquires the optical signal passing through the display screen when the display screen is black, the ambient brightness value can be determined without obtaining the brightness value of the display screen. Compared with the related art, the accuracy of determining the ambient brightness value can be improved.

Figure 6:
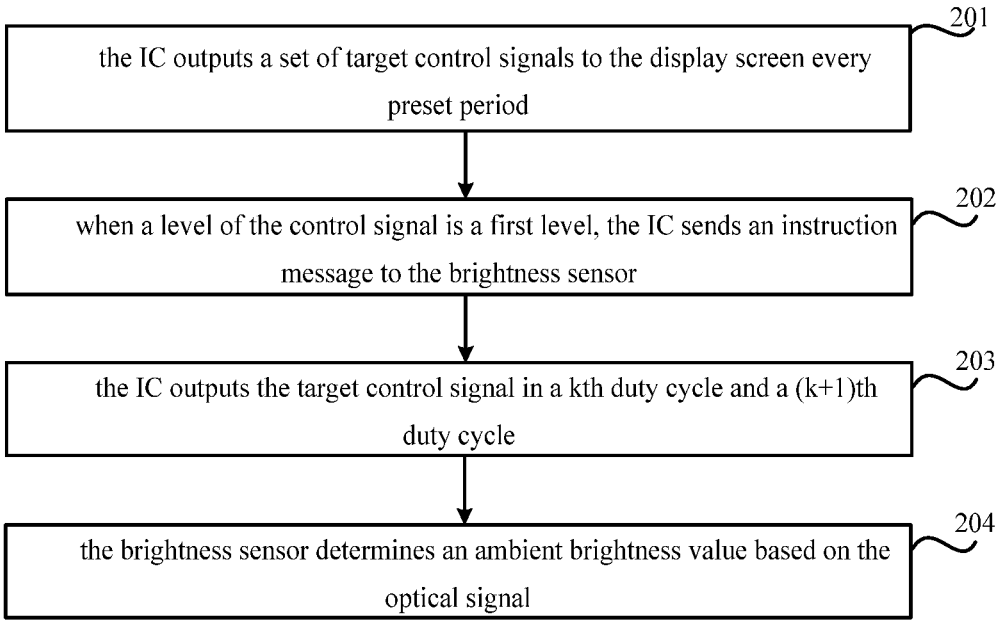
FIG. 6 is a flow chart illustrating a method for determining ambient brightness according to another example.

In embodiments of the present disclosure, one or more brightness sensors may be set under the display screen. As an example, one brightness sensor is disposed under the display screen, and the method for determining ambient brightness according to embodiments of the present disclosure is described below. As illustrated in FIG. 6, the method may include followings.

At block 201, the IC outputs a set of target control signals to the display screen every preset period.

The level of the target control signal may include the first level, and a duration of the first level is greater than or equal to a duration required for the brightness sensor to acquire the optical signal. Illustratively, the first level may be the high level that is configured to control the display screen to display black.

The preset period may include m duty cycles for displaying n image frames, and the duty cycle is a signal cycle of the control signal. The level of the control signal in a duty cycle may include the low level and the high level, or may only include the low level, or may only include the high level. Here, m is an integer greater than 1, n is an integer greater than 1.

For example, assuming that n is 6, and 4 duty cycles is required for displaying one image frame, and then the preset period may include duty cycles for displaying 6 image frames, and 24 duty cycles are included for displaying 6 image frames, i.e., m is 24. The preset period is a period in which the brightness sensor acquires the optical signal passing through the display screen.

In an optional implementation, the IC may output control signals of a plurality of duty cycles, the first half of each duty cycle has a second level, the second level may be the low level, and the second half of each duty cycle has the first level. Then, the IC can output the target control signal to the display screen every preset period, and the target control signal may be the first level of the duty cycle.

In one or more embodiments, assuming that n is 6, the IC can output a set of target control signals to the display screen every 6 image frames, the target control signal may include the first level of the first duty cycle of the seventh frame image.

In another optional implementation, the IC can adjust the control signal such that the first level of each of adjacent two duty cycles can form a continuous first level. In this way, by extending the duration of the continuous first level, it can be ensured that the brightness sensor has sufficient time to acquire the optical signal passing through the display screen.

In at least one embodiment, block 201 may include followings. The IC may output the target control signal in a kth duty cycle and a (k+1)th duty cycle. The target control signal may include control signals of two duty cycles, a first level belonging to a second half of the kth duty cycle and a first level belonging to a first half of the (k+1)th duty cycle form a continuous first level, and a duration of the continuous first level is greater than or equal to the duration required for the brightness sensor to acquire the optical signal.

The kth duty cycle is the last duty cycle of the ith preset period, and the (k+1)th duty cycle is the first duty cycle of the (i+1)th preset period, i is a positive integer.

In embodiments of the present disclosure, when the second half of the kth duty cycle has the first level, in order to ensure that the duration of the first level is greater than or equal to the duration required for the brightness sensor to acquire the optical signal, the IC can adjust the first half of the (k+1)th duty cycle to the first level, such that the second half of the kth duty cycle and the first half of the (k+1)th duty cycle can form the continuous first level, and the duration of the continuous first level is greater than or equal to the duration required for the brightness sensor to acquire the optical signal, thereby ensuring that the brightness sensor has enough time to acquire the optical signal.

Figure 7:
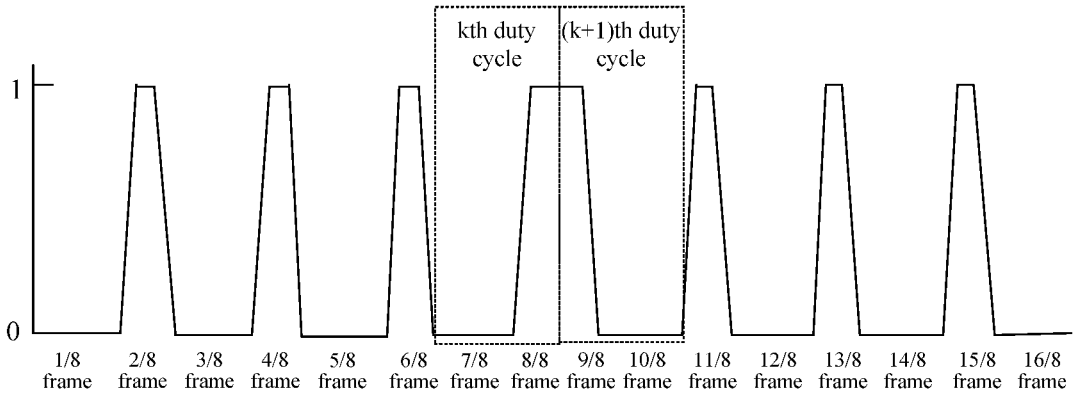
FIG. 7 is a schematic diagram of a time sequence of outputting a target control signal in a kth duty cycle and a (k+1)th duty cycle.

FIG. 7 is a schematic diagram of a time sequence of outputting a target control signal in a kth duty cycle and a (k+1)th duty cycle. In FIG. 7, the abscissa illustrates the display progress of each image frame, and the ordinate illustrates the level value of the control signals outputted by the IC to the display screen. When the level value of the control signal output from the IC to the display screen is 1, it indicates that the control signal has the high level. When the level value of the control signal output from the IC to the display screen is 0, it indicates that the control signal has the low level. Referring to FIG. 7, the second half of the kth duty cycle has the first level, and the first half of the (k+1)th duty cycle has the first level, the first level of the second half in the kth duty cycle and the first level in first half of the (k+1)th duty cycle form the continuous first level.

Figure 8:
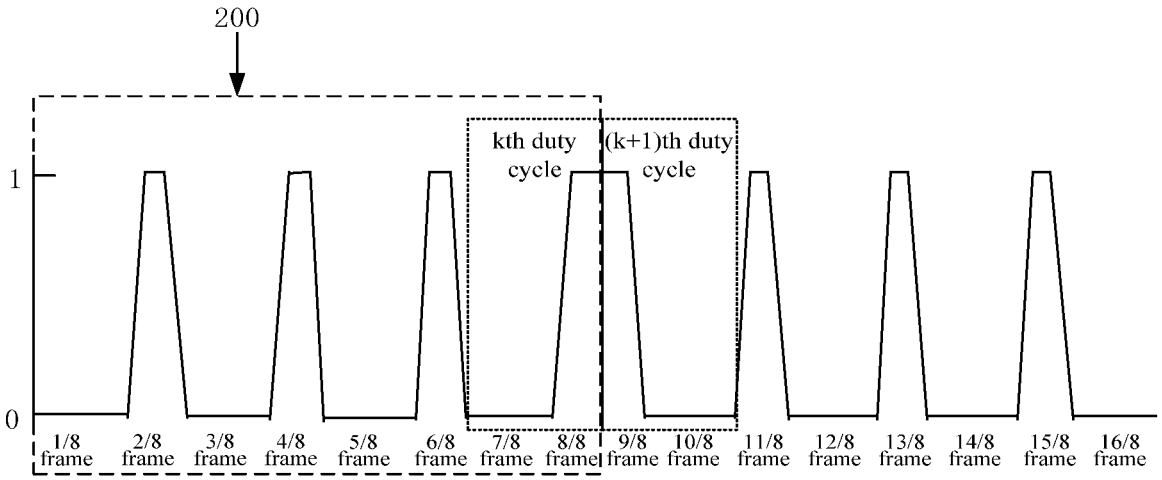
FIG. 8 is schematic diagram of a time sequence of outputting a target control signal in a kth duty cycle and a (k+1)th duty cycle.
Figure 9:
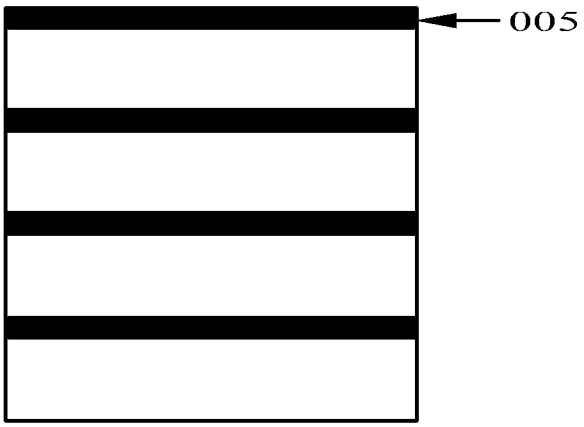
FIG. 9 is a schematic diagram illustrating a control signal displayed on a display screen based on the portion of the time sequence in block 200 of FIG. 8.

FIG. 8 is schematic diagram of a time sequence of outputting a target control signal in a kth duty cycle and a (k+1)th duty cycle. FIG. 9 is a schematic diagram illustrating a control signal displayed on a display screen based on the portion of the time sequence in block 200 of FIG. 8. The first level of the second half in the kth duty cycle in FIG. 8 corresponds to 005 in FIG. 9. The first level is displayed at the top of the display screen.

Figure 10:
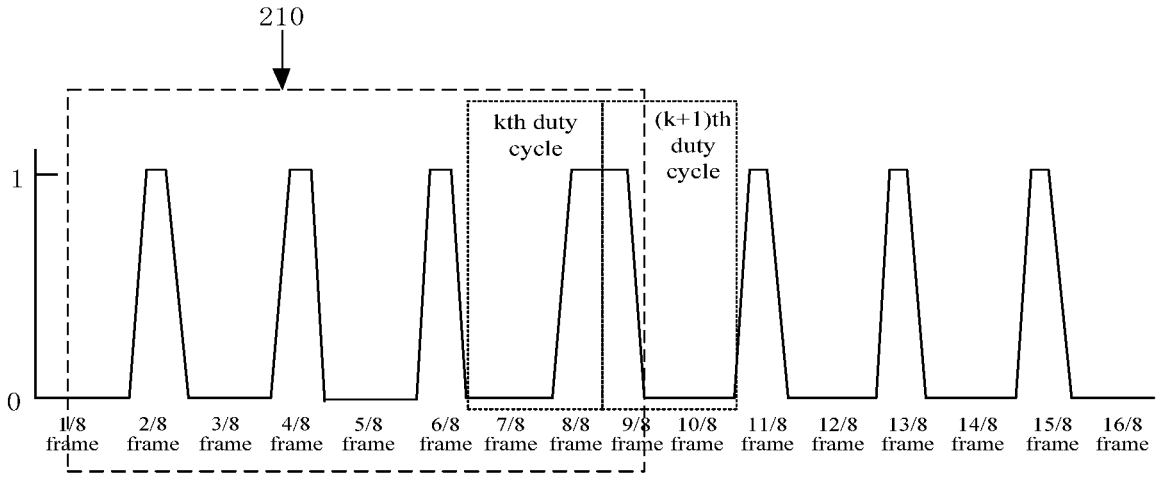
FIG. 10 is schematic diagram of a time sequence of outputting a target control signal in a kth duty cycle and a (k+1)th duty cycle.
Figure 11:
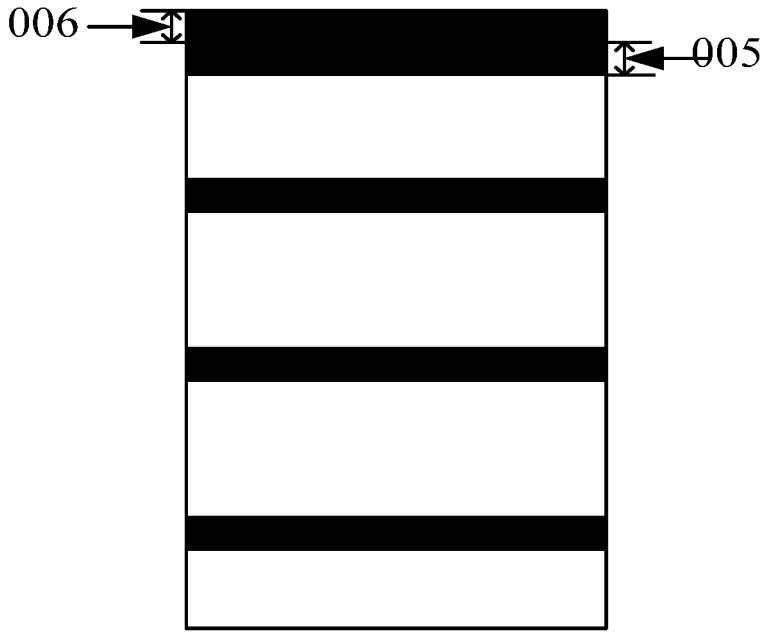
FIG. 11 is a schematic diagram illustrating a control signal displayed on a display screen based on the portion of the time sequence in block 210 of FIG. 10.

FIG. 10 is schematic diagram of a time sequence of outputting a target control signal in a kth duty cycle and a (k+1)th duty cycle. FIG. 11 is a schematic diagram illustrating a control signal displayed on a display screen based on the portion of the time sequence in block 210 of FIG. 10. The first level of the second half in the kth duty cycle in FIG. 10 corresponds to 005 in FIG. 11. The first level of the first half in the (k+1)th duty cycle in FIG. 10 corresponds to 006 in FIG. 11. The second half of the kth duty cycle and the first half of the (k+1)th duty cycle in FIG. 10 form a continuous first level, which corresponds to 005 and 006 in FIG. 11, and the 005 and 006 are target control signals. As can be seen in FIG. 11, the continuous first level is displayed at the top of the display screen.

Figure 12:
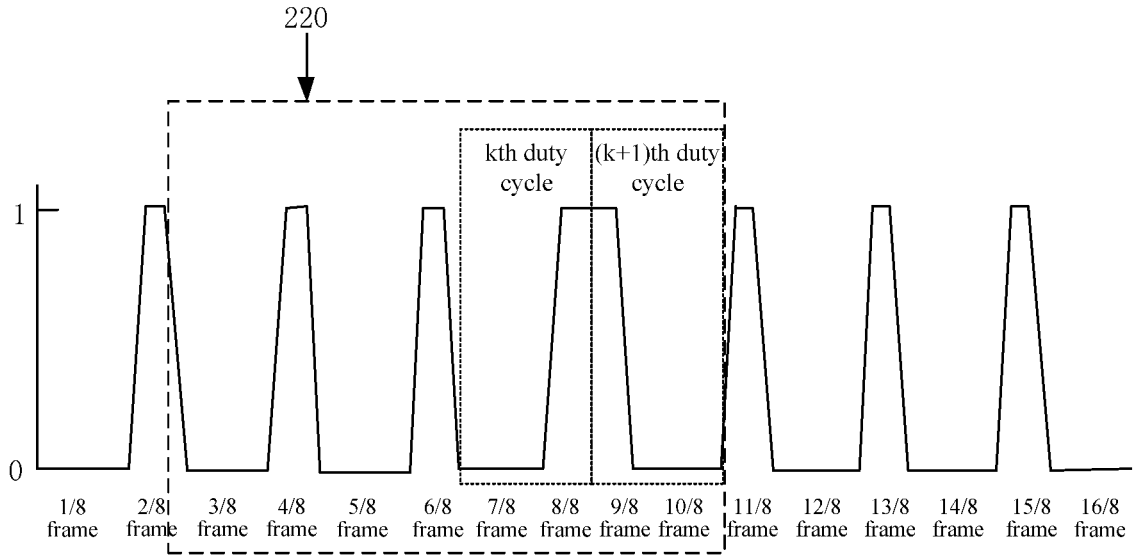
FIG. 12 is schematic diagram of a time sequence of outputting a target control signal in a kth duty cycle and a (k+1)th duty cycle.
Figure 13:
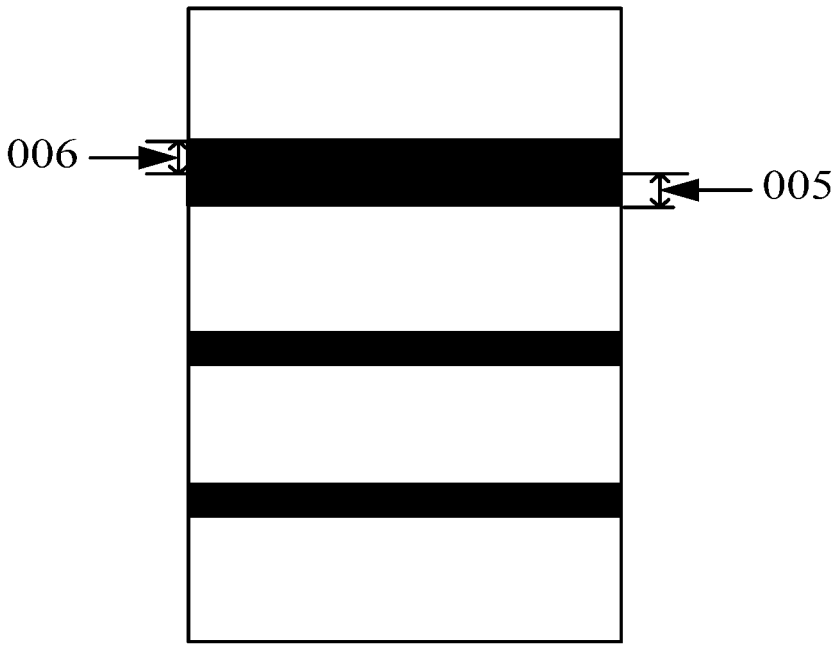
FIG. 13 is a schematic diagram illustrating a control signal displayed on a display screen based on the portion of the time sequence in block 220 of FIG. 12.

FIG. 12 is schematic diagram of a time sequence of outputting a target control signal in a kth duty cycle and a (k+1)th duty cycle. FIG. 13 is a schematic diagram illustrating a control signal displayed on a display screen based on the portion of the time sequence in block 220 of FIG. 12. As can be seen from FIG. 11 and FIG. 13, the target control signals 005 and 006 are moved downward from the top of the display screen.

At block 202, when a level of the control signal is a first level, the IC sends an instruction message to the brightness sensor.

The control signal can be the target control signal. By taking the location of the brightness sensor 130 shown in FIG. 1 as an example, when the duration in which the target control signal moves downward from the top of the display screen is greater than or equal to a preset duration, the IC sends the instruction message to the brightness sensor 130, to cause the brightness sensor 130 to collect the optical signal in the duration of the target control signal. The preset duration may be the duration in which the target control signal moves from the top of the display screen to the location where the brightness sensor 130 is located.

At block 203, the IC outputs the target control signal in a kth duty cycle and a (k+1)th duty cycle.

After the IC sends the instruction message to the brightness sensor, since the first half of the first duty cycle in the (i+1)th preset period has the first level, in order to ensure that the second half of the last duty cycle in the (i+1)th preset period has the first level, such that the first level belonging to the second half of the last duty cycle in the (i+1)th preset period and the first level belonging to the first half of the first duty cycle in the (i+2)th preset period form the continuous first level, the IC needs to readjust the control signal before the last duty cycle of the (i+1)th preset period.

Figure 14:
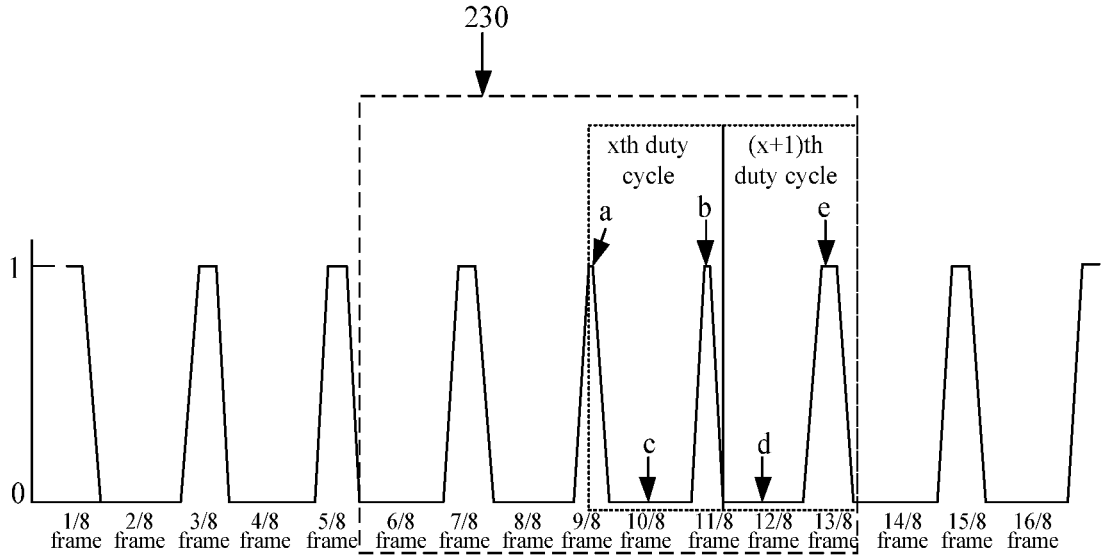
FIG. 14 is schematic diagram of a time sequence of a xth duty cycle and a (x+1)th duty cycle.

FIG. 14 is schematic diagram of a time sequence of a xth duty cycle and a (x+1)th duty cycle. Referring to FIG. 14, the first phase a and the third phase b of the xth duty cycle may have the first level, and the second phase c of the xth duty cycle may have the second level. Illustratively, the second level may be the low level. The first phase d of the (x+1)th duty cycle may have the second level, and the second phase e of the (x+1)th duty cycle may have the first level. The duration of the first level in the second phase e of the (x+1)th duty cycle is equal to the sum of the duration of the first level in the first phase a of the xth duty cycle and the duration of the first level in the third phase b of xth duty cycle, and the duration of the second level in the first phase d of the (x+1)th duty cycle is equal to the duration of the second level in the second phase c of the xth duty cycle.

The xth duty cycle is the first duty cycle of a $$\left(\frac{n}{2}+1\right)$$

th image frame in the (i+1)th preset period, and the (x+1)th duty cycle is the second duty cycle of the $$\left(\frac{n}{2}+1\right)$$

th image frame in the (i+1)th preset period.

By adjusting the output mode of the xth duty cycle, the first level in the control signal of the xth duty cycle is output to the display screen in two different phases, such that the first phase of each from the (x+1)th duty cycle to the last duty cycle of the (i+1)th preset period has the second level, and the second phase of each from the (x+1)th duty cycle to the last duty cycle of the (i+1)th preset period has the first level, ensuring that the first level belonging to the second half of the last duty cycle in the (i+1)th preset period and the first level belonging to the first half of the first duty cycle in the (i+2)th preset period can form a continuous first level, such that the brightness sensor can have sufficient time to acquire the optical signal passing through the display screen at the next time.

Figure 15:
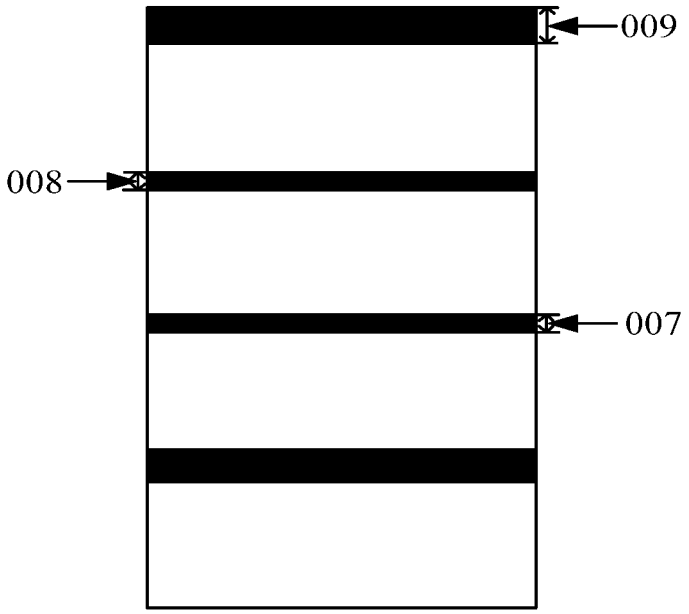
FIG. 15 is a schematic diagram illustrating a control signal displayed on a display screen based on the portion of the time sequence in block 230 of FIG. 14.

FIG. 15 is a schematic diagram illustrating a control signal displayed on a display screen based on the portion of the time sequence in block 230 of FIG. 14. The first level of the first phase a in the xth duty cycle in FIG. 14 corresponds to 007 in FIG. 15. The first level of the third phase b in the xth duty cycle in FIG. 14 corresponds to 008 in FIG. 15. The first level of the second phase e in the (x+1)th duty cycle in FIG. 14 corresponds to 009 in FIG. 15. It can be seen from FIG. 14 that, after the xth duty cycle is divided into three phases, the first phase of the (x+1)th duty cycle has the low level, and the second phase has the high level.

Assuming that the (i+1)th preset period includes 6 image frames, the xth duty cycle may be the first duty cycle of the 4th image frame in the (i+1)th preset period, and the (i+1)th duty cycle may be the second duty cycle of the 4th image frame in the (i+1)th preset period.

At block 204, the brightness sensor determines an ambient brightness value based on the optical signal.

In embodiments of the present disclosure, the brightness sensor can convert the acquired optical signal into the electrical signal, and determine the ambient brightness value based on the electrical signal. In another optional implementation, the brightness sensor may also convert the acquired optical signal into the electrical signal, and send the electrical signal to the processor, to cause the processor to determine the ambient brightness value based on the electrical signal.

As described above, with the method for determining ambient brightness according to embodiments of the present disclosure, the IC outputs the control signal to the display screen, when the level of the control signal is the first level, the IC sends the instruction message to the brightness sensor, to cause the brightness sensor to acquire the optical signal passing through the display screen and to determine the ambient brightness value based on the optical signal. The first level is configured to control the display screen to display black. Since the brightness sensor acquires the optical signal passing through the display screen when the display screen is black, the ambient brightness value can be determined without obtaining the brightness value of the display screen, and compared with the related art, accuracy of determining the ambient brightness value can be improved.

Figure 16:
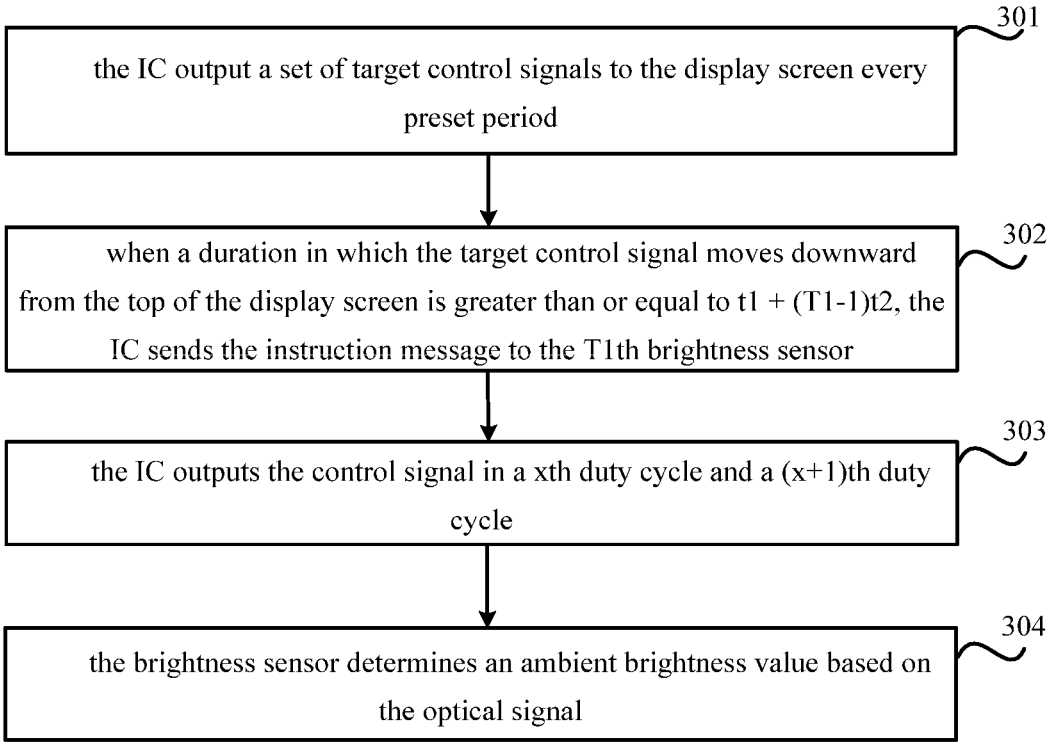
FIG. 16 is a flow chart illustrating a method for determining ambient brightness according to another example.

When a plurality of brightness sensors are disposed under the display screen, referring to FIG. 2, when a plurality of brightness sensors 130 are evenly disposed in different areas of the display screen in a vertical direction, as illustrated in FIG. 16, the method may include followings.

At block 301, the IC outputs a set of target control signals to the display screen every preset period.

Block 301 can refer to block 201, and details are not described herein again.

At block 302, when a duration in which the target control signal moves downward from the top of the display screen is greater than or equal to $t1+(T1-1)\times t2$, the IC sends the instruction message to the T1th brightness sensor.

t1 denotes a duration in which the target control signal moves from the top of the display screen to the first brightness sensor, for example, 130A in FIG. 2, adjacent to the top of the display screen, $$t2 = \frac{v}{p},$$

p denotes the number of the brightness sensors, and v denotes $$\frac{m}{n}$$

duty cycles for displaying one image frame.

Since the brightness sensors are distributed in different areas of the display screen in the vertical direction from top to bottom, when the target control signal moves downward from the top of the display screen to a location where a brightness sensor is located, the IC can send an instruction message to the brightness sensor at the location, such that in the process of the display screen displaying one image frame, the plurality of brightness sensors uniformly distributed in different areas of the display screen in the vertical direction can acquire optical signals passing through the display screen, the duration in which the brightness sensor collects the optical signal passing through the display screen is increased, and the accuracy of determining the ambient brightness value is improved.

By taking the brightness sensor distributed in different areas of the display screen in the vertical direction shown in FIG. 2 as an example, assuming that v is 4, p is 4, and then t2 is 1. The duration in which the target control signal moves downward from the top of the display screen is t3.

When T1 is 1, if $t3>t1$, it indicates that the target control signal moves to the location where the first brightness sensor 130A is located in FIG. 2, the IC can send the instruction message to the brightness sensor at the first duty cycle, to instruct the first brightness sensor on the display screen to acquire the optical signal passing through the display screen.

When T1 is 2, if $t3>t1+t2$ (i.e., $t3>t1+1$), it indicates that the target control signal moves to the location where the second brightness sensor 130B is located in FIG. 2, the IC can send the instruction message to the brightness sensor at the second duty cycle, to instruct the second brightness sensor on the display screen to acquire the optical signal passing through the display screen.

When T1 is 3, if $t3>t1+t2$ (i.e., $t3>t1+2$), it indicates that the target control signal moves to the location where the third brightness sensor 130C is located in FIG. 2, the IC can send the instruction message to the brightness sensor at the third duty cycle, to instruct the third brightness sensor on the display screen to acquire the optical signal passing through the display screen.

When T1 is 4, if $t3>t1+t2$ (i.e., $t3>t1+3$), it indicates that the target control signal moves to the location where the fourth brightness sensor 130D is located in FIG. 2, the IC can send the instruction message to the brightness sensor at the fourth duty cycle, to instruct the fourth brightness sensor on the display screen to acquire the optical signal passing through the display screen.

At block 303, the IC outputs the control signal in a xth duty cycle and a (x+1)th duty cycle.

Block 303 can refer to block 203, and details are not described herein again.

At block 304, the brightness sensor determines an ambient brightness value based on the optical signal.

Since the optical signal passing through the display screen is acquired by the brightness sensors disposed in different areas under the display screen, after each brightness sensor converts the acquired optical signal into the electrical signal and sends the electrical signal to the processor, the processor can calculate an average value of the plurality of electrical signals, and determine the ambient brightness value based on the average value, thus the accuracy of determining the ambient brightness value is improved.

It should be noted that, the sequence of steps in the method for determining ambient brightness according to embodiments of the present disclosure may be appropriately adjusted, and the steps may also be correspondingly increased or decreased according to actual situation, and, any method that can easily be conceived by those skilled in the art within the scope of the present disclosure is intended to be included in the protection scope of the present disclosure, and therefore will not be described again.

As described above, with the method for determining ambient brightness according to embodiments of the present disclosure, the IC outputs the control signal to the display screen, when the level of the control signal is the first level, the IC sends the instruction message to the brightness sensor, to instruct the brightness sensor to acquire the optical signal passing through the display screen and to determine the ambient brightness value based on the optical signal. The first level is configured to control the display screen to display black. Since the brightness sensor acquires the optical signal passing through the display screen when the display screen is black, the ambient brightness value can be determined without obtaining the brightness value of the display screen, and compared with the related art, the accuracy of determining the ambient brightness value is improved.

Figure 17:
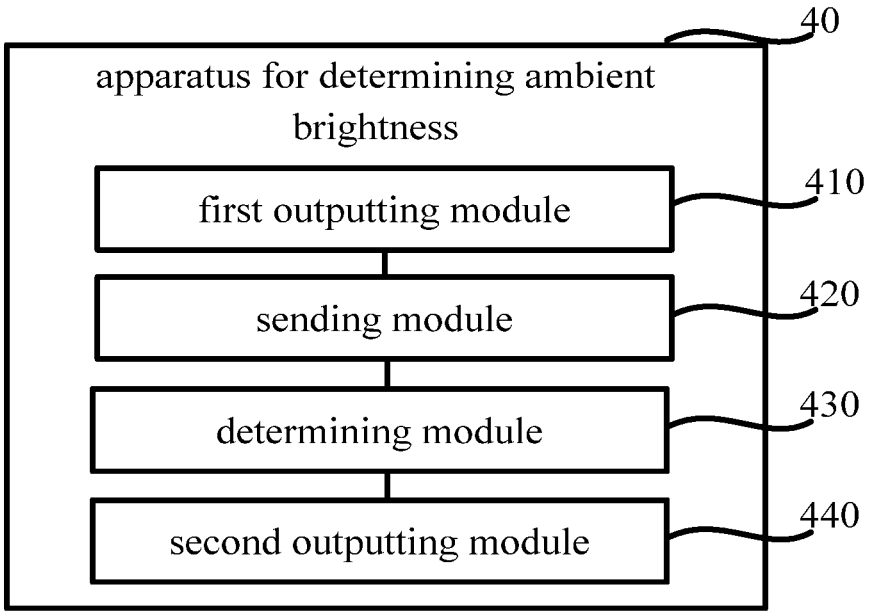
FIG. 17 is a block diagram illustrating an apparatus for determining ambient brightness according to an example.

Embodiments of the present disclosure further provide a device 40 for determining ambient brightness. The device is applicable to a terminal having an integrated circuit IC, a display screen and a brightness sensor, and the brightness sensor is disposed under the display screen. As illustrated in FIG. 17, the device includes a first outputting module 410, a sending module 420 and a determining module 430.

The first outputting module 410 is configured to control the IC to output a control signal to the display screen. The control signal is configured to control brightness of the display screen.

The sending module 420 is configured to control the IC to send an instruction message to the brightness sensor when a level of the control signal is a first level. The first level is configured to control the display screen to display black, and the instruction message is configured to instruct the brightness sensor to acquire an optical signal passing through the display screen.

The determining module 430 is configured to control the brightness sensor to determine an ambient brightness value based on the optical signal.

As described above, with the device for determining ambient brightness according to embodiments of the present disclosure, the IC outputs the control signal to the display screen, when the level of the control signal is the first level, the IC sends the instruction message to the brightness sensor, to instruct the brightness sensor to acquire the optical signal passing through the display screen and to determine the ambient brightness value based on the optical signal. The first level is configured to control the display screen to display black. Since the brightness sensor acquires the optical signal passing through the display screen when the display screen is black, the ambient brightness value can be determined without obtaining the brightness value of the display screen, and compared with the related art, the accuracy of determining the ambient brightness value can be improved.

Figure 18:
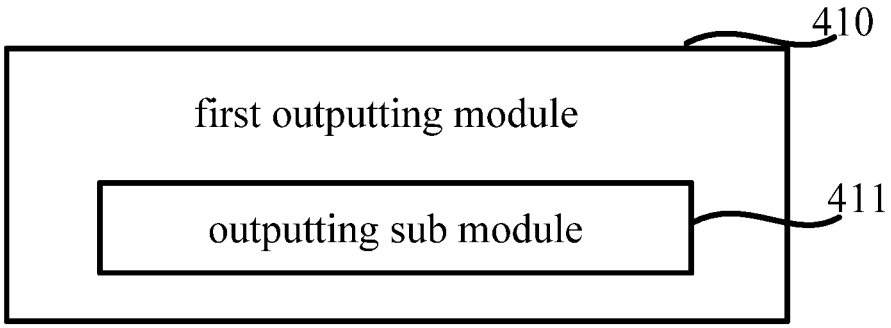
FIG. 18 is a block diagram of a first outputting module according to an example.

In at least one embodiment, as illustrated in FIG. 18, the first outputting module includes an outputting sub module 411. The outputting sub module 411 is configured to control the IC to output a set of target control signals to the display screen every preset period. The target control signal includes the first level, and a duration of the first level is greater than or equal to a duration required for the brightness sensor to acquire the optical signal.

The preset period includes m duty cycles for displaying n image frames, and the duty cycle is a signal cycle of the control signal.

In at least one embodiment, the outputting sub module 411 is configured to control the IC to output the target control signal in a kth duty cycle and a (k+1)th duty cycle. The target control signal includes control signals of two duty cycles, a first level belonging to a second half of the kth duty cycle and a first level belonging to a first half of the (k+1)th duty cycle form a continuous first level, and a duration of the continuous first level is greater than or equal to the duration required for the brightness sensor to acquire the optical signal.

The kth duty cycle is the last duty cycle of the ith preset period, and the (k+1)th duty cycle is the first duty cycle of the (i+1)th preset period, i is a positive integer.

In at least one embodiment, a plurality of brightness sensors are evenly distributed in different areas of the display screen in a vertical direction.

The sending module 420 is configured to control the IC to send the instruction message to the brightness sensor at a T1th duty cycle when a duration in which the target control signal moves downward from the top of the display screen is greater than or equal to $t1+(T1-1)\times t2$, where t1 denotes a duration in which the target control signal moves from the top of the display screen to the first brightness sensor, $$t2 = \frac{v}{p},$$

p denotes the number of the brightness sensors, and v denotes $$\frac{m}{n}$$

duty cycles for displaying one image frame.

In at least one embodiment, as illustrated in FIG. 17, the device further includes a second outputting module 440. The second outputting module 440 is configured to control the IC to output the control signal in a xth duty cycle and a (x+1)th duty cycle. The control signal has the first level in a first phase and a third phase of the xth duty cycle, has a second level in a second phase of the xth duty cycle, has the second level in a first phase of the (x+1)th duty cycle, and has the first level in a second phase of the (x+1)th duty cycle. A duration of the first level in the (x+1)th duty cycle is equal to a sum of a duration of the first level in the first phase of the xth duty cycle and a duration of the first level in the third phase of the xth duty cycle, and a duration of the second level in the first phase of the (x+1)th duty cycle is equal to a duration of the second level in the second phase of the xth duty cycle.

The xth duty cycle is the first duty cycle of a $$\left(\frac{n}{2}+1\right)$$

th image frame in the (i+1)th preset period, and the (x+1)th duty cycle is the second duty cycle of a $$\left(\frac{n}{2}+1\right)$$

th image frame in the (i+1)th preset period.

As described above, with the device for determining ambient brightness according to embodiments of the present disclosure, the IC outputs the control signal to the display screen, when the level of the control signal is the first level, the IC sends the instruction message to the brightness sensor, to instruct the brightness sensor to acquire the optical signal passing through the display screen and to determine the ambient brightness value based on the optical signal. The first level is configured to control the display screen to display black. Since the brightness sensor acquires the optical signal passing through the display screen when the display screen is black, the ambient brightness value can be determined without obtaining the brightness value of the display screen, and compared with the related art, the accuracy of determining the ambient brightness value can be improved.

Embodiments of the present disclosure further provide an apparatus for determining ambient brightness, which is applicable to a terminal having an integrated circuit IC, a display screen and a brightness sensor, and the brightness sensor is disposed under the display screen. The apparatus includes a processor and a memory configured to store instructions executable by the processor. The processor is configured to: output a control signal by the IC to the display screen, the control signal being configured to control brightness of the display screen; send an instruction message by the IC to the brightness sensor when a level of the control signal is a first level, the first level being configured to control the display screen to display black, the instruction message being configured to instruct the brightness sensor to acquire an optical signal passing through the display screen; and determine an ambient brightness value by the brightness sensor based on the optical signal.

As described above, with the apparatus for determining ambient brightness according to embodiments of the present disclosure, the IC outputs the control signal to the display screen, when the level of the control signal is the first level, the IC sends the instruction message to the brightness sensor, to instruct the brightness sensor to acquire the optical signal passing through the display screen and to determine the ambient brightness value based on the optical signal. The first level is configured to control the display screen to display black. Since the brightness sensor acquires the optical signal passing through the display screen when the display screen is black, the ambient brightness value can be determined without obtaining the brightness value of the display screen, and compared with the related art, the accuracy of determining the ambient brightness value is improved.

Embodiments of the present disclosure further provide a storage medium having instructions stored therein. When the storage medium is run on a processing circuitry, the processing circuitry is caused to perform the method for determining ambient brightness illustrated in FIG. 5, FIG. 6 or FIG. 16.

FIG. 19 is a block diagram showing a device for determining ambient brightness according to an exemplary embodiment. For example, the device 500 may be a mobile phone, a computer, a digital broadcasting terminal, a game console, a tablet device, a medical device, a fitness device and a personal digital assistant, etc.

Referring to FIG. 19, the device 500 may include the following one or more components: a processing circuitry 502, a memory 504, a power component 506, a multimedia component 508, an audio component 510, an input/output (I/O) interface 512, a sensor component 514, and a communication component 516.

The processing circuitry 502 typically controls overall operations of the device 500, such as the operations associated with display, telephone calls, data communications, camera operations, and recording operations. The processing circuitry 502 may include one or more processors 520 to execute instructions to perform all or part of the steps in the above described methods. Moreover, the processing circuitry 502 may include one or more modules which facilitate the interaction between the processing circuitry 502 and other components. For instance, the processing circuitry 502 may include a multimedia module to facilitate the interaction between the multimedia component 508 and the processing circuitry 502.

The memory 504 is configured to store various types of data to support the operation of the device 500. Examples of such data include instructions for any applications or methods operated on the device 500, contact data, phonebook data, messages, pictures, video, etc. The memory 504 may be implemented using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 506 provides power to various components of the device 500. The power component 506 may include a power management system, one or more power sources, and any other components associated with the generation, management, and distribution of power in the device 500.

The multimedia component 508 includes a screen providing an output interface between the device 500 and the user. In some embodiments, the screen may include a liquid crystal display (LCD) and a press panel (TP). If the screen includes the press panel, the screen may be implemented as a press screen to receive input signals from the user. The press panel includes one or more press sensors to sense presses, swipes, and other gestures on the press panel. The press sensors may not only sense a boundary of a press or swipe action, but also sense a duration time and a pressure associated with the press or swipe action. In some embodiments, the multimedia component 508 includes a front camera and/or a rear camera. The front camera and/or the rear camera may receive external multimedia data while the device 500 is in an operation mode, such as a photographing mode or a video mode. Each of the front camera and the rear camera may be a fixed optical lens system or have focus and optical zoom capability.

The audio component 510 is configured to output and/or input audio signals. For example, the audio component 510 includes a microphone (MIC) configured to receive an external audio signal when the device 500 is in an operation mode, such as a call mode, a recording mode, and a voice recognition mode. The received audio signal may be further stored in the memory 504 or transmitted via the communication component 516. In some embodiments, the audio component 510 further includes a speaker to output audio signals.

The I/O interface 512 provides an interface for the processing circuitry 502 and peripheral interface modules, such as a keyboard, a click wheel, buttons, and the like. The buttons may include, but are not limited to, a home button, a volume button, a starting button, and a locking button.

The sensor component 514 includes one or more sensors to provide status assessments of various aspects of the device 500. For instance, the sensor component 514 may detect an open/closed status of the device 500 and relative positioning of components (e.g. the display and the keypad of the device 500). The sensor component 514 may also detect a change in position of the device 500 or of a component in the device 500, a presence or absence of user contact with the device 500, an orientation or an acceleration/deceleration of the device 500, and a change in temperature of the device 500. The sensor component 514 may include a proximity sensor configured to detect the presence of nearby objects without any physical contact. The sensor component 514 may also include a light sensor, such as a CMOS or CCD image sensor, for use in imaging applications. In some embodiments, the sensor component 514 may also include an accelerometer sensor, a gyroscope sensor, a magnetic sensor, a pressure sensor, or a temperature sensor.

The communication component 516 is configured to facilitate wired or wireless communication between the device 500 and other devices. The device 500 can access a wireless network based on a communication standard, such as WIFI, 2G, or 3G, or a combination thereof. In one exemplary embodiment, the communication component 516 receives a broadcast signal or broadcast associated information from an external broadcast management system via a broadcast channel. In one exemplary embodiment, the communication component 516 further includes a near field communication (NFC) module to facilitate short-range communications. For example, the NFC module may be implemented based on a radio frequency identification (RFID) technology, an infrared data association (IrDA) technology, an ultra-wideband (UWB) technology, a Bluetooth (BT) technology, and other technologies.

In exemplary embodiments, the device 500 may be implemented with one or more application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components, for performing the method illustrated in FIG. 5, FIG. 6 or FIG. 16.

In exemplary embodiments, there is also provided a non-transitory computer readable storage medium including instructions, such as the memory 504 including instructions. The above instructions are executable by the processor 520 in the device 500, for performing the above-described methods. For example, the non-transitory computer-readable storage medium may be a ROM, a RAM, a CD-ROM, a magnetic tape, a floppy disc, an optical data storage device, and the like.

With regard to the device in the above embodiments, the specific manner in which the respective modules perform the operations has been described in detail in embodiments related to the method, and will not be explained in detail herein.

Other embodiments of the present disclosure will be apparent to those skilled in the art from consideration of the specification and practice of the present disclosure disclosed here. This application is intended to cover any variations, uses, or adaptations of the present disclosure following the general principles thereof and including such departures from the present disclosure as come within known or customary practice in the art. It is intended that the specification and embodiments be considered as exemplary only, with a true scope and spirit of the present disclosure being indicated by the following claims.

It is to be understood that, the present disclosure is not limited to the exact construction that has been described above and illustrated in the accompanying drawings, and that various modifications and changes can be made without departing form the scope thereof. It is intended that the scope of the present disclosure only be limited by the appended claims.

What is claimed is:

1. A method for determining ambient brightness, applicable to a terminal having an integrated circuit (IC), a display screen, and a brightness sensor, the brightness sensor being disposed under the display screen, the method comprising:

outputting a control signal by the IC to the display screen, the control signal being configured to control brightness of the display screen, wherein outputting the control signal by the IC to the display screen comprises:

outputting a set of target control signals by the IC to the display screen every preset period, the target control signal comprising the first level, a duration of the first level being greater than or equal to a duration required for the brightness sensor to acquire the optical signal;

wherein the preset period comprises m duty cycles for displaying n image frames, and the duty cycle is a signal cycle of the control signal, where m and n are positive integers;

sending an instruction message by the IC to the brightness sensor when a level of the control signal is a first level, the first level being configured to control the display screen to display black, the instruction message being configured to instruct the brightness sensor to acquire an optical signal passing through the display screen; and determining an ambient brightness value by the brightness sensor based on the optical signal.

2. The method according to claim 1, wherein outputting a set of target control signals by the IC to the display screen every preset period comprises:

outputting the target control signal by the IC in a kth duty cycle and a (k+1)th duty cycle, the target control signal comprising control signals of two duty cycles, a first level belonging to a second half of the kth duty cycle and a first level belonging to a first half of the (k+1)th duty cycle forming a continuous first level, and a duration of the continuous first level being greater than or equal to the duration required for the brightness sensor to acquire the optical signal;

wherein the kth duty cycle is the last duty cycle of the ith preset period, and the (k+1)th duty cycle is the first duty cycle of the (i+1)th preset period, i is a positive integer.

3. The method according to claim 1, wherein a plurality of brightness sensors are evenly distributed in different areas of the display screen in a vertical direction;

sending the instruction message by the IC to the brightness sensor when the level of the control signal is the first level comprises:

sending the instruction message by the IC to the brightness sensor at a Tlth duty cycle when a duration in which the target control signal moves downward from the top of the display screen is greater than or equal to $t1+(T1-1)\times t2$, where t1 denotes a duration in which the target control signal moves from the top of the display screen to a first brightness sensor adjacent to the top of the display screen, t2=p denotes the number of the brightness sensors, and v denotes m duty cycles for displaying one image frame.

4. The method according to claim 3, wherein after sending the instruction message by the IC to the brightness sensor, the method further comprises:

outputting the control signal by the IC in a xth duty cycle and a (x+1)th duty cycle, the control signal having the first level in a first phase and a third phase of the xth duty cycle, having a second level in a second phase of the xth duty cycle, having the second level in a first phase of the (x+1)th duty cycle, and having the first level in a second phase of the (x+1)th duty cycle, a duration of the first level in the (x+1)th duty cycle being equal to a sum of a duration of the first level in the first phase of the xth duty cycle and a duration of the first level in the third phase of the xth duty cycle, and a duration of the second level in the first phase of the (x+1)th duty cycle being equal to a duration of the second level in the second phase of the xth duty cycle;

wherein the xth duty cycle is the first duty cycle of a $({}^{11}{}_{n}/2+1)$th image frame in the (i+1)th preset period, and the (x+1)th duty cycle is the second duty cycle of the $({}^{1}{}_{2}+1)$th image frame in the (i+1)th preset period.

5. A device for determining ambient brightness, applicable to a terminal having an integrated circuit (IC), a display screen and a brightness sensor, the brightness sensor being disposed under the display screen, the device comprising:

a processor; and a memory configured to store instructions executable by the processor;

wherein the processor is configured to:

control the IC to output a control signal to the display screen, the control signal being configured to control brightness of the display screen;

control the IC to output a set of target control signals to the display screen every preset period, the target control signal comprising the first level, a duration of the first level being greater than or equal to a duration required for the brightness sensor to acquire the optical signal, wherein the preset period comprises m duty cycles for displaying n image frames, and the duty cycle is a signal cycle of the control signal, where m and n are positive integers;

control the IC to send an instruction message to the brightness sensor when a level of the control signal is a first level, the first level being configured to control the display screen to display black, the instruction message being configured to instruct the brightness sensor to acquire an optical signal passing through the display screen; and control the brightness sensor to determine an ambient brightness value based on the optical signal.

6. The device according to claim 5, wherein the processor is further configured to:

control the IC to output the target control signal in a kth duty cycle and a (k+1)th duty cycle, the target control signal comprising control signals of two duty cycles, a first level belonging to a second half of the kth duty cycle and a first level belonging to a first half of the (k+1)th duty cycle forming a continuous first level, and a duration of the continuous first level being greater than or equal to the duration required for the brightness sensor to acquire the optical signal;

wherein the kth duty cycle is the last duty cycle of the ith preset period, and the (k+1)th duty cycle is the first duty cycle of the (i+1)th preset period, i is a positive integer.

7. The device according to claim 5, wherein a plurality of brightness sensors are evenly distributed in different areas of the display screen in a vertical direction;

the processor is configured to:

control the IC to send the instruction message to the brightness sensor at a Tlth duty cycle when a duration in which the target control signal moves downward from the top of the display screen is greater than or equal to $t1+(T1-1)\times t2$, where t1 denotes a duration in which the target control signal moves from the top of the display screen to a first brightness sensor adjacent to the top of the display screen, t2=p denotes the number of the brightness sensors, and v denotes m duty cycles for displaying one image frame.

8. The device according to claim 7, wherein the processor is further configured to:

control the IC to output the control signal in a xth duty cycle and a (x+1)th duty cycle, the control signal having the first level in a first phase and a third phase of the xth duty cycle, having a second level in a second phase of the xth duty cycle, having the second level in a first phase of the (x+1)th duty cycle, and having the first level in a second phase of the (x+1)th duty cycle, a duration of the first level in the (x+1)th duty cycle being equal to a sum of a duration of the first level in the first phase of the xth duty cycle and a duration of the first level in the third phase of the xth duty cycle, and a duration of the second level in the first phase of the (x+1)th duty cycle being equal to a duration of the second level in the second phase of the xth duty cycle;

wherein the xth duty cycle is the first duty cycle of a $(^{11}{}_{2}+1)$th image frame in the (i+1)th preset period, and the (x+1)th duty cycle is the second duty cycle of the $(^{1}{}_{2}+1)$th image frame in the (i+1)th preset period.

9. A storage medium having instructions stored therein, wherein when the instructions are executed by a processing circuitry, the processing circuitry is caused to perform acts comprising:

outputting a control signal by an integrated circuit (IC) to a display screen, the control signal being configured to control brightness of the display screen, wherein outputting the control signal by the IC to the display screen comprises:

outputting a set of target control signals by the IC to the display screen every preset period, the target control signal comprising the first level, a duration of the first level being greater than or equal to a duration required for the brightness sensor to acquire the optical signal; and wherein the preset period comprises m duty cycles for displaying n image frames, and the duty cycle is a signal cycle of the control signal, where m and n are positive integers;

sending an instruction message by the IC to a brightness sensor when a level of the control signal is a first level, the first level being configured to control the display screen to display black, the instruction message being configured to instruct the brightness sensor to acquire an optical signal passing through the display screen; and determining an ambient brightness value by the brightness sensor based on the optical signal.

10. The storage medium according to claim 9, wherein outputting a set of target control signals by the IC to the display screen every preset period comprises:

outputting the target control signal by the IC in a kth duty cycle and a (k+1)th duty cycle, the target control signal comprising control signals of two duty cycles, a first level belonging to a second half of the kth duty cycle and a first level belonging to a first half of the (k+1)th duty cycle forming a continuous first level, and a duration of the continuous first level being greater than or equal to the duration required for the brightness sensor to acquire the optical signal;

wherein the kth duty cycle is the last duty cycle of the ith preset period, and the (k+1)th duty cycle is the first duty cycle of the (i+1)th preset period, i is a positive integer.

11. The storage medium according to claim 9, wherein a plurality of brightness sensors are evenly distributed in different areas of the display screen in a vertical direction;

sending the instruction message by the IC to the brightness sensor when the level of the control signal is the first level comprises:

sending the instruction message by the IC to the brightness sensor at a T1th duty cycle when a duration in which the target control signal moves downward from the top of the display screen is greater than or equal to $t1+(T1-1)\times t2$, where t1 denotes a duration in which the target control signal moves from the top of the display screen to a first brightness sensor adjacent to the top of the display screen, t2=p denotes the number of the brightness sensors, and v denotes m duty cycles for displaying one image frame.

12. The storage medium according to claim 11, wherein after sending the instruction message by the IC to the brightness sensor, the acts further comprise:

outputting the control signal by the IC in a xth duty cycle and a (x+1)th duty cycle, the control signal having the first level in a first phase and a third phase of the xth duty cycle, having a second level in a second phase of the xth duty cycle, having the second level in a first phase of the (x+1)th duty cycle, and having the first level in a second phase of the (x+1)th duty cycle, a duration of the first level in the (x+1)th duty cycle being equal to a sum of a duration of the first level in the first phase of the xth duty cycle and a duration of the first level in the third phase of the xth duty cycle, and a duration of the second level in the first phase of the (x+1)th duty cycle being equal to a duration of the second level in the second phase of the xth duty cycle;

wherein the xth duty cycle is the first duty cycle of a $({}^{11}{}_{2}+1)$th image frame in the (i+1)th preset period, and the (x+1)th duty cycle is the second duty cycle of the $({}^{1}{}_{2}1)$th image frame in the (i+1)th preset period.

* * * * *